US006821053B2

(12) United States Patent
Martinez

(10) Patent No.: US 6,821,053 B2
(45) Date of Patent: Nov. 23, 2004

(54) WATER FLOW RESPONSIVE BARRIER FOR GUTTERS AND STORM DRAINS WITH ROTARY ACTUATOR

(76) Inventor: Antonio Martinez, 2413 N. Mountain View Rd., El Monte, CA (US) 91733

( * ) Notice: Subject to any disclaimer, the term of this patent is extended or adjusted under 35 U.S.C. 154(b) by 0 days.

(21) Appl. No.: 10/355,735

(22) Filed: Jan. 31, 2003

(65) Prior Publication Data

US 2004/0151546 A1 Aug. 5, 2004

(51) Int. Cl.[7] ..... E02B 13/00; E03F 5/06

(52) U.S. Cl. ..... 405/40; 405/36; 405/37; 405/127; 404/4

(58) Field of Search ..... 405/36, 40, 41, 405/46, 127, 124, 37; 210/532.1, 163, 170, 747; 404/2–5; 52/11–14

(56) References Cited

U.S. PATENT DOCUMENTS

| | | | | | |
|---|---|---|---|---|---|
| 440,067 | A | * | 11/1890 | Smith | 210/163 |
| 506,267 | A | * | 10/1893 | Sefton | 210/163 |
| 1,245,903 | A | * | 11/1917 | Gross | 210/163 |
| 5,403,474 | A | * | 4/1995 | Emery | 210/163 |
| 6,015,489 | A | * | 1/2000 | Allen et al. | 404/4 |
| 6,217,756 | B1 | * | 4/2001 | Martinez | 404/4 |

FOREIGN PATENT DOCUMENTS

GB 2241905 * 9/1991

* cited by examiner

*Primary Examiner*—Jong-Suk (James) Lee
(74) *Attorney, Agent, or Firm*—Donald D. Mon

(57) ABSTRACT

A barrier to exclude trash and debris from storm drains wich includes a pivoted gate moved by a vane-type rotor. The rotor is actuated to open an entry to the storm drain by flow of water at a rate above and agreeable minimum, and to maintain it closed at no or low flow rates.

11 Claims, 3 Drawing Sheets

WATER FLOW RESPONSIVE BARRIER FOR GUTTERS AND STORM DRAINS WITH ROTARY ACTUATOR

FIELD OF THE INVENTION

Exclusion of debris and trash from gutter and storm drains except during high rates of stream flow.

BACKGROUND OF THE INVENTION

It is the intended function of gutters and storm drains to carry away water during storms that might otherwise flood adjacent areas. It has become commonplace to observe that when unregulated, all of the trash and contaminants from upstream locations will finally arrive at some downstream location to the disadvantage of the environment at the place of ultimate discharge.

A prominent example is Los Angeles County, Calif., where the run-off from an area of many square miles discharges into very local outfalls in the Pacific Ocean at places near to residential and recreational usage. One well-known example is Santa Monica bay, and there are others. Especially after heavy storms, beaches for miles are restricted from public usage until after many tides have diluted and washed away what had arrived at the coast. Similar situations arise elsewhere along many rivers and in many valleys.

The original generation of this burden can be only partially averted by local means. People will still wash cars, rake leaves, and deposit trash in gutters and storm drains. This and other solid debris will somehow reach this major system. However, the storm drainage system is not designed for trash collection. Instead it is intended to protect an urban area from floods of water when heavy rains occur, while still draining away the water generated during normal events, such as light rains and normal processes like over-watering lawns and washing cars.

The problem is that during dry periods, solid materials still find their way into the system, either because of its regular generation upstream, or because people put things into it. Unless removed it clogs the system and will not carry the water away. A flood results. As a consequence, every such system is regularly cleaned out, hopefully before the next heavy rain. Vacuum trucks, persons in hazmat suits going into manholes, and the like regularly do this expensive work.

The least expensive removal work is the mechanical street sweeper. It can routinely sweep up accumulations of solid material, from gutters. However, this cannot be a daily event. Usually it will be once a week. In the meantime, the solids can accumulate or be put into the system.

There can be only partial solutions, anywhere, to the total situation, and they will largely be local. However, each time a problem is at least partially solved upstream, for the load downstream where many upstream sources converge, each one can be an important improvement. The problem is to remove all that one can, while still allowing normal living and natural functions to be accommodated.

It is an object of this invention to exclude during periods of no or low water flow undesirable solid materials from drainage systems. During such dry periods, the solids will remain in their usual first collection sites, mainly gutters. These can be swept away by sweepers, and will not have to be removed from collection basins, nor will they arrive at a river or ocean. The ultimate burden is vastly reduced.

The objective of barring the passage of solids at the entrance of a curb or storm drain opening is shown in Martinez U.S. Pat. No. 6,217,756. This patent shows a pivoted gate at the entrance to a system that remains closed to large solids, but permits flow of water around and/or through it.

An actuator in the form of a bucket is suspended in the system where slowly-flowing water will not reach it, but rapidly flowing water will. When a sufficient weight of water is in the bucket, it will open the gate. Holes in the bucket drain the water, so that sufficient water in the bucket to open the barrier remains only when the flow rate is sufficiently high.

This product depends for its successful operation on the balance between the rate of flow of water into the bucket, and the rate of flow out of its holes. This requires that the bucket and its drain holes remain "clean". A problem is that debris can accumulate in the bucket and the drain holes can plug up. This is a fail-safe arrangement, because the tendency is to retain water and keep the barrier open. Thus there is no risk of closure which might result in flooding. It can, however, fail to close when the rain stops.

It is an object of this invention to overcome the disadvantages of a system actuated by the collection of water with a dynamic system which, while responsive to rate of water flow, also is self-cleaning, so that in the absence of a sufficient dynamic force, the system remains closed to the entry of solids.

BRIEF DESCRIPTION OF THE INVENTION

A water flow responsive barrier according to this invention includes a gate pivoted so as to occlude, at least in part, or to leave open, an entry into a drainage system. Its most characteristic application is in the curbside entry into a drainage chamber. Such chambers are enlarged regions intended to hold accumulations of larger solids before they can pass into a larger system downstream from them. Most of these chambers are surmounted by manholes. These manholes are routinely entered to clean them out.

The entry is generally formed at a rectangular opening with two opposite sides, a top, and a bottom sill. Water entering the entry flows over the sill. At slow flow rates water such as overflow from lawns, washing of cars, and light rains, merely drains over the sill, and does not project far into the chamber. As such, it will not actuate the barrier, and the gate will remain closed. Slow water flows past or through it, while the gate continues to bar trash from entering the chamber.

According to this invention, a rotor is pivotally mounted in the chamber where it will be encountered by a rapidly flowing stream, such as from a heavy rain. This rotor carries vanes which are impinged on by the rapid stream which turns the rotor. The rotor then actuates linkage which will pivot the gate open to permit rapid flow of water. It will also pass such solids as may have been permitted to accumulate in the gutter. Flooding will not result.

According to a feature of this invention, the vanes do not accumulate water in the sense of a bucket or container. Instead they act in response to a dynamic load.

Accordingly to a preferred but optional feature of the invention, the vanes are open at least at one end, so there is no risk of their being plugged or accumulating water or debris.

The above and other features of this invention will be fully understood from the following detailed description and the accompanying drawings, in which:

DETAILED DESCRIPTION OF THE INVENTION

Figure 1:
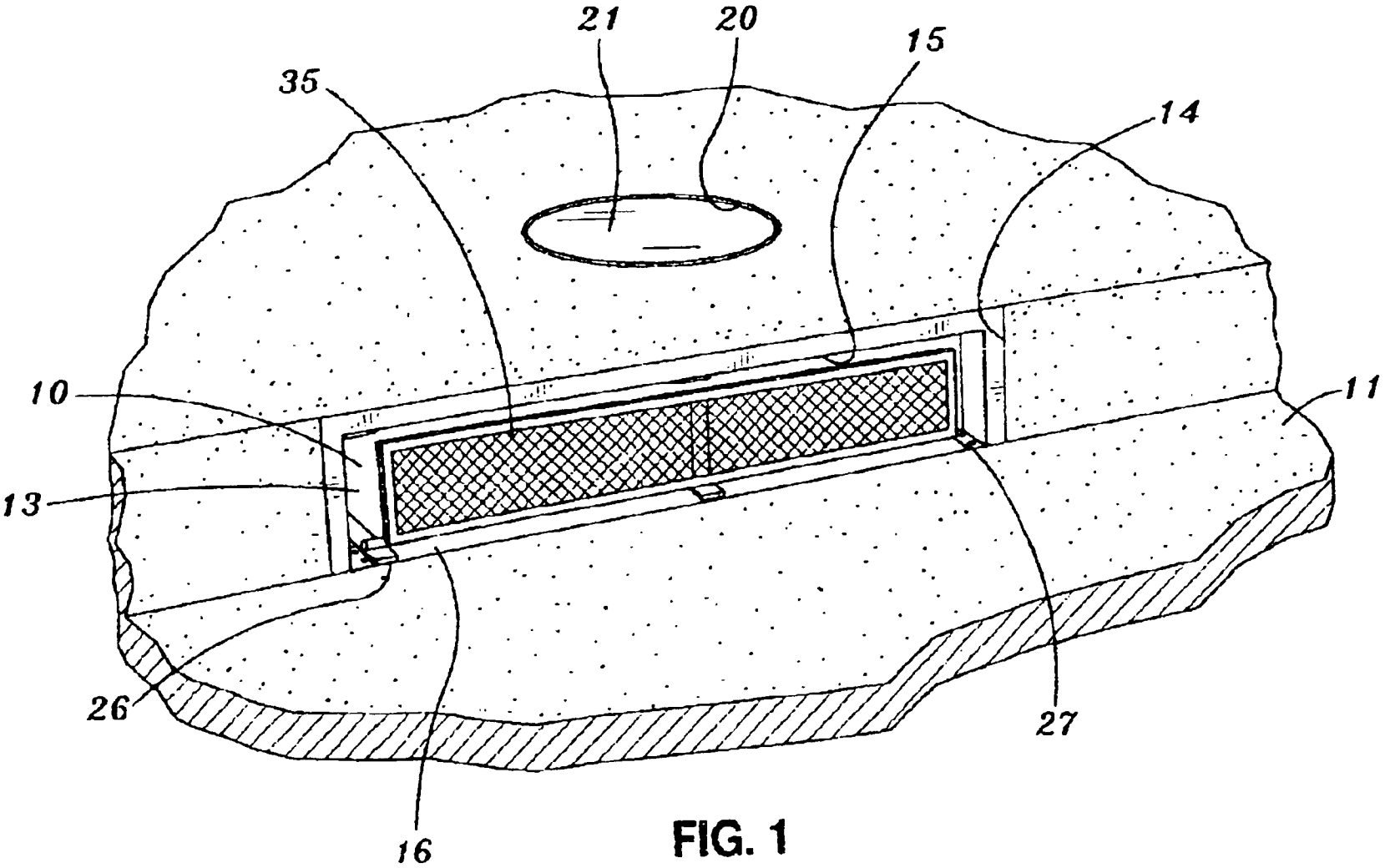
FIG. 1 is a perspective view showing the system of the invention installed in a curb.
Figure 2:
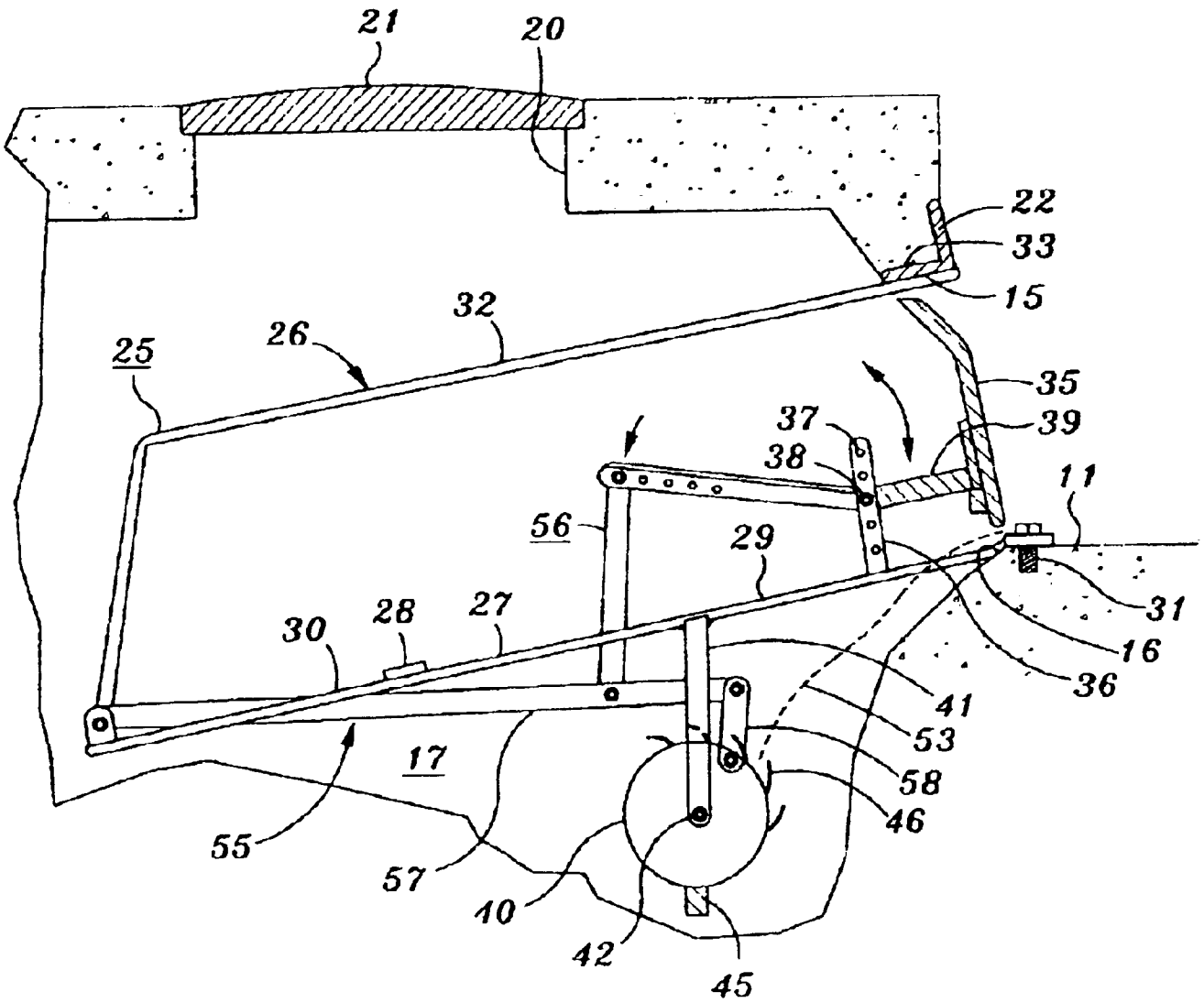
FIG. 2 is a side view partly in cross-section showing the system of FIG. 1.

FIGS. 1 and 2 show the entry 10 from a gutter 11 through a curb 12. The entry has two sidewalls 13, 14, a top 15, and a bottom sill 16. The sill is located at the gutter level. It forms an entry into a collector chamber 17 into which water flows, and from which water is discharged into a downstream system. The objective of this invention is to prevent trash and other debris from entering the chamber, thereby reducing the need to clean it out.

A manhole 20 with a cover 21 is provided at the top to give access for cleaning purposes. In most installations the upper edge 22 of the curb will directly overhang the sill. However, more recent designs place edge 22 behind the sill as shown in FIG. 2. This invention is adaptable to both arrangements.

As best shown in FIG. 2, a frame 25 is fitted in the entry. It comprises a pair of identical U-shaped stiff metal straps 26, 27 which are interconnected by bars 28, 29. The straps are identical, so only strap 26 is shown in detail. Its lower arm 30 is fastened to the sill by a fastener 31 drawn into the sill.

Its upper arm 32 is fixed to the top of the entry, for example by a weld to a usually-present metal angle 33. This frame is now a rigid installation inside the chamber. The straps are usually about one inch wide, so they do not form a significant impediment to flow of water.

A gate 35 is mounted to the frame by a hinge plate 36. Plural holes 37 are formed in the plate to receive a hinge pin 38 that pivots a lever 39. Gate 35 is mounted to one arm of the lever. In the position illustrated in FIG. 2, the gate is down and closed. The left hand end of the lever is up. When the lever is rotated to lift the gate, the left hand end is pulled down as will be disclosed.

Figure 3:
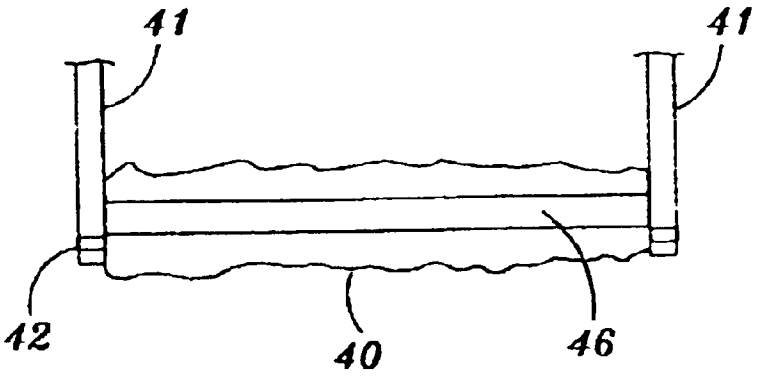
FIG. 3 is a fragmentary view of a rotor in FIG. 2.

A rotor 40 (FIGS. 2 and 3) is pivoted to an axle support 41. Support 41 is fixed such as by a weld to the lower arm 27 of the strap 26. The rotor extends between the pair of supports and is rotatable around an axle 42. The rotor is shown as a complete cylinder, but may instead be only a partial cylinder as preferred, or even by a group of vanes.

A counterweight 45 is attached to the rotor, which exerts a prevailing force to return the rotor to the illustrated position with the gate closed.

A plurality of vanes 46 is formed on the rotor. These vanes extend axially along the rotor, from end to end. They may conveniently be made of strips of rigid curved material attached to the rotor structure. High flow water, schematically shown at 53 will flow far enough into the chamber to impinge on these vanes and tend to turn the rotor clockwise in FIG. 2, against the forces exerted by the counterweight. Slowly flowing water, merely flows down the wall of the chamber and does not impinge on the vanes. The gate leaves sufficient gaps around it, or provides openings sufficient for enough water to pass it to start the rotor turning.

The vanes are open-ended at at least one end so water and debris drain away and will not accumulate in them. The system is reliably drained and relies on dynamic force to open the gate.

Actuator linkage 55 includes a pull link 56 pivotally attached to lever 39 on its side away from the gate. In turn the pull link is pivotally attached to a base link 57, which in turn is connected to a slack link 58. The slack link is pivotally connected to the base link and to the rotor.

The operation of this device is straight forward. When there is no flow or slow flow, the counterweight rotates the rotor to the position of FIG. 2. This pushes the slack link, the base link, and the pull link all upwardly, and thereby moves the gate down to occlude the entry.

When the flow is rapid enough, the water impinges on the vanes, rotating the rotor, pulling pull link 56 down, and rotating lever 39 to lift the gate. This situation will prevail as long as the rapid flow persists.

The arrangement of FIG. 2 is presently preferred, because it most conveniently removes the gate from the entry. However, there may be installations where the surroundings are too close and it is necessary to hinge the gate to the entry itself. Such hinges can be at either the top or bottom of the entry as preferred.

In all of these arrangements, the rotor can be employed to equal advantage with simple modifications to the linkages. Two such modifications are shown schematically in FIGS. 4 and 5. It will be understood that these are not to scale nor necessarily accurately proportioned. A skilled designer can readily adapt these systems when he knows the dimensions and anticipated forces for a specific installation.

Figure 4:
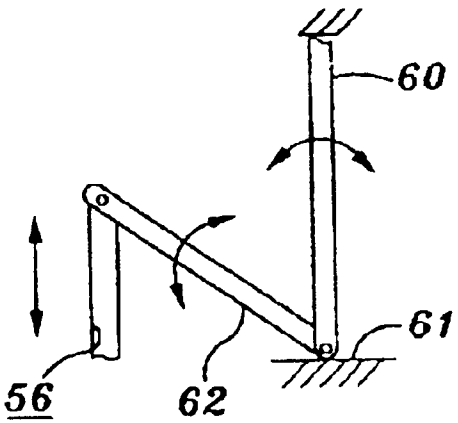
FIG. 4 is a schematic view of another embodiment of the invention.

FIG. 4 schematically shows a gate 60 hinged at its bottom to a sill 61. It extends across the entry when closed, and is pulled down to open the entry. Structures similar to that of FIG. 2 is shown, and pull link 56 from that system is shown as the driving link from a rotor (not shown).

A lever 62 is fixed to the gate and hinged to pull link 56. When the rotor is in its repose condition (FIG. 2), lever 62 is up and the gate is closed. When the rotor rotates, pull link 56 is pulled down, which pulls down lever 62 and opens the gate.

Figure 5:
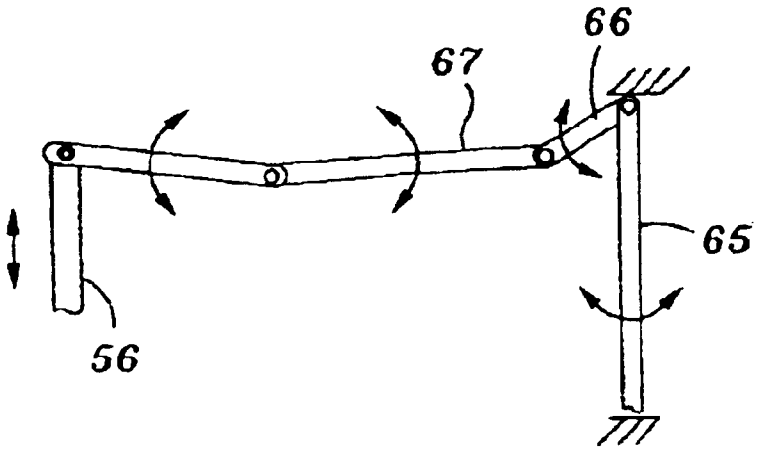
FIG. 5 is a schematic view of yet another embodiment of the invention.

FIG. 5 schematically shows a gate 65 hinged to the top of the entry. A lever 66 is fixed to this gate and to a rocker arm 67 pivoted to the frame. In turn the rocker arm is pivoted to pull link 56. It will be seen that the rocker arm has reversed the applied force of the pull lever, so an upward force is exerted on the gate lever to open the gate.

The pertinence of the structures of FIGS. 4 and 5 is to emphasize the wide applicability of use of the rotor to actuate the system, and especially of a rotor which depends on dynamic force rather than sustained weight from its operation.

This invention is not to be limited by the embodiments shown in the drawings and described in the description, which are given by way of example and not of limitation, but only in accordance with the scope of the appended claims.

I claim:

1. A barrier system which closes to exclude trash and debris from passing through an opening into a chamber when accompanied by water flowing at an acceptably slow or slower rate of flow, and which opens to permit passage of the trash and debris and water when the flow rate of the water is at a faster rate which equals or exceeds said acceptably slow or slower rate, said opening formed in a rigid structure where said system will receive said water from said opening, said system comprising:

a hingedly mounted gate having a closed position across said opening and an open position rotatable to a position where said gate does not substantially occlude said opening, said system permitting flow of water past said gate while the flow rate is acceptably slow or slower and the gate is in its closed position;

a rotor rotatably mounted in said chamber so disposed and arranged as to be impacted by water flowing at said faster rate, said rotor including a plurality of vanes in the path of said water whose impact force cause the rotor to rotate, and a counterweight opposing said rotation; and linkage interconnecting said rotor and said gate, so disposed and arranged that the vanes are spaced far enough away that the vanes are not impinged upon by water at said acceptably slow or slower rates, but will be impinged upon at said faster rates, which cause said rotor to actuate said linkage to open said gate to its open position.

2. A barrier system according to claim 1 in which said vanes are troughs open on at least one of their ends.

3. A barrier system according to claim 2 in which said vanes are troughs open at both ends.

4. A barrier system according to claim 1 in which said gate is pivotally mounted to a frame in said chamber, and in which said linkage exerts a force tending to move said gate between said closed position and said open position.

5. A barrier system according to claim 1 in which said gate is pivotally mounted to structure surrounding said opening and in which said linkage causes said gate to pivot to open or to close said opening in response to the rotary position of the rotor.

6. A barrier system according to claim 5 in which said opening is partially defined by a sill at its bottom over which water flows into the opening, said gate being mounted to said sill.

7. A barrier system according to claim 5 in which said gate is mounted to said structure at the top of said opening.

8. In a barrier system which closes to exclude trash and debris from passing through an opening into a chamber when accompanied by water flowing at an acceptably slow or slower rate of flow, and which opens to permit passage of the trash and debris and water when the flow rate of the water is at a faster rate which equals or exceeds said acceptably slow or slower rate, said opening formed in rigid structure where said system will receive said water, said system including a hingedly mounted gate to having a closed position across said opening and rotatable to an open position where said date does not substantially occlude said opening, said system permitting flow of water past said gate while the flow rate is acceptably slow or slower and the said gate is therefore in its closed position; and a linkage system adapted to move the gate to its open or to its closed position, the improvement comprising:

a rotor having an axis of rotation, and a plurality of vanes, said vanes lying in the path of water at said faster rate, whereby to turn said rotor, and for the rotor to actuate said linkage.

9. The improvement of claim 8 in which said vanes are troughs open on at least one of their ends.

10. The improvement of claim 9 in which said vane are troughs open at both ends.

11. The improvement of claim 8 further including a counterweight opposing rotation of said rotor.

* * * * *